United States Patent [19]

Kinsey

[11] 4,136,730

[45] Jan. 30, 1979

[54] HEATING AND COOLING EFFICIENCY CONTROL

[76] Inventor: Bernard B. Kinsey, 102 Skyline Dr., Austin, Tex. 78746

[21] Appl. No.: 817,100

[22] Filed: Jul. 19, 1977

[51] Int. Cl.[2] ..... F28D 21/00

[52] U.S. Cl. ..... 165/12; 62/231

[58] Field of Search ..... 165/12, 14, 26, 27; 236/46; 62/157, 231

[56] References Cited

U.S. PATENT DOCUMENTS

| | | | |
|---|---|---|---|
| 2,835,448 | 5/1958 | Page | 236/9 A |
| 3,454,078 | 7/1969 | Elwart | 165/27 |
| 3,489,345 | 1/1970 | Moreland | 236/9 A |
| 3,599,710 | 8/1971 | Joslin | 165/26 |
| 3,726,473 | 4/1973 | Sapir | 236/11 |
| 3,912,162 | 10/1975 | Bauer et al. | 236/11 |

*Primary Examiner*—Edgar W. Geoghegan
*Attorney, Agent, or Firm*—Bacon & Thomas

[57] ABSTRACT

The efficiency of an air conditioner or furnace is markedly increased by limiting the time of operation of the compressor or burner to a maximum time of from 10 to 15 minutes by means of a primary timer responsive to a conventional thermostat. A blower timer then causes the blower to continue operation for 10 to 15 minutes after the compressor or burner is shut off.

10 Claims, 1 Drawing Figure

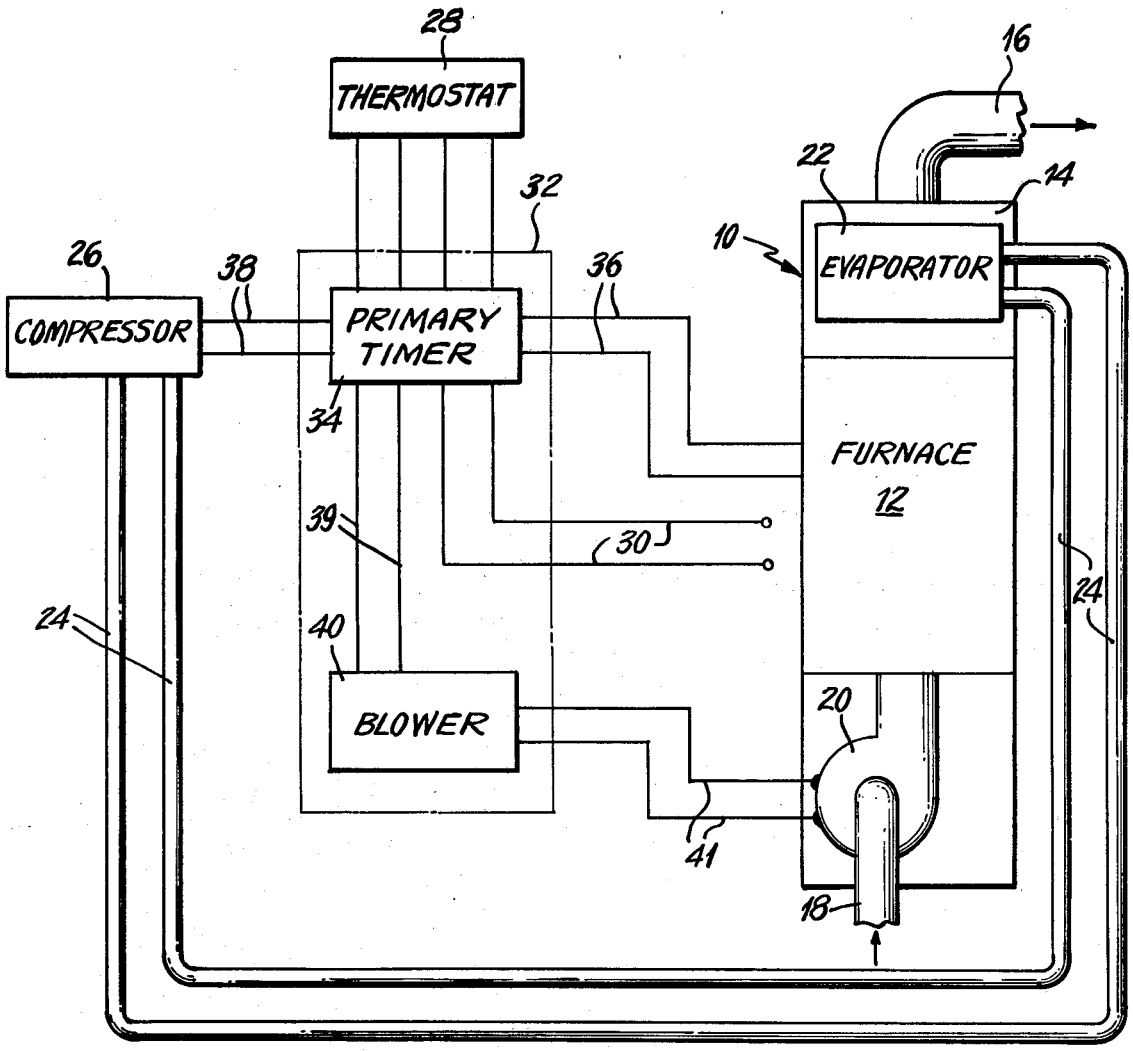
28
THERMOSTAT
16
22
14
32
10
EVAPORATOR
26
38
36
COMPRESSOR
PRIMARY TIMER
34
FURNACE
12
39
30
24
24
40
BLOWER
20
41
18

HEATING AND COOLING EFFICIENCY CONTROL

BACKGROUND OF THE INVENTION

This invention is in the field of heating and cooling devices and methods of operating the same.

Measurements of air conditioners have shown that in the southern United States some 40% of refrigerant capacity is expended in condensing water vapor. Not more than one-third of this is necessary for cooling or for comfort; the rest is wasted. While most of the condensed water drains outside of the building, there is always a quart or so left adhering to the cooling plates when the compressor is turned off by the thermostat. This can be evaporated by allowing the blower to continue for some 15 minutes after the compressor is turned off, thus providing additional cooling to the air stream. Since the amount of cold recovered is roughly the same every time the compressor is turned off, it is advantageous to turn it off as often as possible. However, reducing the time that the compressor is on, while fixing the time the blower continues after the compressor is turned off, reduces the net cooling capacity of the system. When the compressor comes on intermittently, this is of no consequence; but at peak load (7 to 8 pm), the thermostat may well require that the compressor is in continuous operation. At the time of peak load, and with no restriction on the time for which the compressor is turned on, then, there is no evaporation and the condensed water is lost. With the Efficiency Control, recovery is effected by interrupting the compressor, and fixing an upper limit to the time it is allowed to operate. A compromise which gives good recovery (on average two-thirds of that 40%) and adequate capacity is obtained by making this upper limit also 15 minutes. This constraint is the more important because thermostats can be sluggish in response, unfortunately located in pockets of stagnant air; or, owing to poor insulation, construction, or design of houses, air conditioners are, more often than not, of insufficient capacity to cope with the peak load. It follows that for a few hours near the time of the peak load, the temperature within the house will rise a degree or two above that set by the thermostat, a rise of which most residents are unaware. With the Efficiency Control in operation, this temperature rise will be a little higher, but again to no noticeable degree, and at less power consumption by a third.

A better understanding may be obtained by considering the cooling process in more detail. As the compressor is turned on, the blower being in continuous operation, there is a rapid and nearly exponential fall in temperature of the air stream as cold is stored in the cooler and ducts. When the compressor is turned off, there is a similar rapid rise in temperature, followed by a long tail, usually lasting 20 minutes. All air conditioners show this tail, roughly in the same proportion and lasting for the same time. It is caused by the evaporation of water (2 to 4 pints) which adhere to the 100 square feet or so of cooling plates. It is the cold represented by this tail, resulting from the evaporation of condensed water, which is passed into the air stream and prolongs the cooling of the air conditioner. A roughly equal cooling effect is, therefore, restored to the house every time the air conditioner is turned off provided that the blower is allowed to continue after the turning off of the compressor. Reducing the time that the compressor is on has the effect of requiring it to come on more often with increasing contributions of cold passed on to the house. If this time is too short, no water is condensed and the temperature within the house would fall to the dew point, where the humidity is 100 percent. Although conditions commonly occurring would make this very unlikely, too short a time certainly leads to excessive humidity. At the time of peak load, and with (as is usually the case) an inadequate air conditioner, the compressor will come on for the maximum time allowed by the Efficiency Control. The longer this time, the more water is lost to the system by condensation and less cold is recoverable. By making it 15 minutes, about two-thirds of the condensed water is evaporated in the 15 minutes that the blower is on following the turning off of the compressor. This is the basis of the compromise referred to above. In these conditions, then, the same cooling rate is provided with the Efficiency Control in operation for about two-thirds of the electric power, at the price, however, of an average cooling capacity less than without it, and an increase in humidity of a few percent. Taking into account times other than that of peak load, the overall improvement in power consumption is even better.

Centrally cooled and heated systems are conventionally controlled by thermostats fitted with an 'auto' position, the blower coming on automatically when the compressor is turned on, or with an 'on' position where the blower is on continuously until turned off manually. Without the Efficiency Control, the 'auto' position has nothing to recommend it, for no condensed water is evaporated, and serious losses can occur when the compressor and blower are not running. In the 'on' position, power savings are obtained because the same process of evaporation described above can occur when the thermostat interrupts the compressor. However, such savings are lower than those obtained with the Efficiency Control in operation, because there is no interruption of the compressor at times of peak load, and the blower, being on continuously, runs longer than is necessary.

Although furnace operation has nothing equivalent to the cold recoverable from evaporation of condensed water in air conditioners, measurements show that there is always more heat recoverable from a furnace cooling down after being turned off, than is put into it when heating up, the difference being independent of the time for which the furnace is turned on. The explanation of this surprising fact lies in the two-stage process which determines heat transfer in a furnace. As with air conditioners, then, it is advantageous to turn the furnace on and off as often as possible. Measurements show that a suitable maximum furnace 'on' time is 10 minutes, while limiting the blower to run for 10 minutes after the furnace is turned off. The savings of fuel which result depend on circumstances, but will usually amount to some 20 percent.

Blower controls for removal of stored heat have been suggested in U.S. Pat. Nos. granted to J. F. Page, 2,835,448, G. E. Elwart, 3,454,078, and C. D. Moreland, 3,489,345, of which the most noticeable common feature is the proposed variation of the speed of the blower, slower speeds at appropriate times supposedly increasing comfort. This may be so, but there can be no doubt that decreasing the flow of air can only decrease the efficiency of a furnace, whatever its temperature, if only because the heat transfer between furnace walls and air stream depends on the Reynolds number of the latter: decreasing the air velocity produces a nearly proportional decrease in heat transfer, with a corresponding increase in temperature of the furnace walls. Since the primary transfer of heat between the furnace flames and these walls is almost entirely radiative, increasing the wall temperature sharply reduces the heat transfer from within, with, consequently, more heat going up the chimney. Other U.S. Pat. Nos. granted, e. g. those to D. N. Joslin, 3,599,710, S. Sapir, 3,726,473, and F. T. Bauer, 3,912,162, are similar. All are concerned with improvements in comfort; none involve any real improvement in fuel consumption, and where suggested that such improvements might result, are quite clearly in error. The prior patents referred to depend on the temperature of the air being treated for their operation.

SUMMARY OF THE INVENTION

The device and method of the present invention is specifically promoted for energy conservation; increase in comfort which might arise from changing the performance of the blower by lowering its speed is eschewed on the grounds that such alterations must necessarily lead to a decrease in energy efficiency. The device consists essentially of two electronic timing circuits working with four relays. One of these circuits determines the time that the compressor or furnace is turned on, fixing a maximum to this time; the other ensures the continuation of blower operation after the compressor or furnace is turned off. Switches allow for summer operation of the air conditioner (both times 15 minutes) or winter operation of the furnace (both times 10 minutes). Another switch allows the device to be put out of operation if required.

Measurements show that this device will increase the efficiency of a three or four ton air conditioner by some 30% at peak load. At other times when the air conditioner comes on intermittently considerable amounts of cold which would be lost by conduction or convection in the absence of this device are also recovered, the improvements amounting to as much as 100%. The net diurnal improvement is about 40%. This means that only two-thirds of the electric power is required to give the same cooling. Except at times of peak load, some of this improvement can be obtained by running the blower continuously. However, blowers usually take 300 to 600 watts, so continuous blower operation is wasteful. The Efficiency Control ensures that the blower is on for the minimum time required for full recovery.

For furnaces full recovery of the stored heat is obtained by allowing the blower to continue for 10 minutes beyond that time when the furnace burner is turned off. When the furnace comes on intermittently, say once every twenty minutes or so, as much as 10% of the stored heat is lost in the absence of the Efficiency Control; for longer periods even larger losses are incurred. Moreover, measurements show that, as is to be expected, the efficiency of the furnace is higher the lower the average temperature of the ignition chamber. When the furnace is on for 10 minutes, the additional heat is 5% higher than would be obtained in continuous running of the furnace for an equal time, and twice as much as this for half the time. Thus, in all, running the blower for 10 minutes after the furnace is turned off, and fixing an upper limit of 10 minutes to the time for which the furnace can be turned on, some 10 to 25% extra heat is obtained for the same gas or other fuel consumption.

This invention secures optimum performance of existing air conditioners and furnaces by the addition of an electrical device to control both the times when the blower and the compressor (or the furnace burner) is turned on and off. Measurements have shown that for air conditioners, the power consumption required to give a certain degree of cooling may amount to as much as 30% to 50% above that required by the present invention; and up to 20% for furnaces.

BRIEF DESCRIPTION OF THE DRAWINGS

The single FIGURE of the drawings is a block diagram representation of a system for controlling the efficiency of a furnace-air conditioner combination.

DESCRIPTION OF A PREFERRED EMBODIMENT

Referring to the drawing, numeral 10 designates what may be termed a conventional furnace having a firebox 12, a plenum chamber 14, a distribution duct 16, an inlet duct 18, and blower 20. As is conventional, the blower 20 draws return air from an enclosure such as a home or the like and directs the air through the heat exchanger of the furnace 12 to the plenum chamber 14 and then through the distribution duct 16 to the areas being heated. As is conventional, an air conditioner evaporator 22 is shown as positioned in the plenum chamber 14 and connected by refrigerant conduits 24 to a compressor-condenser apparatus 26. The arrangement thus far described is conventional, all parts of which are known and in use, in many installations.

As is also conventional, operation of the furnace and/or air conditioner is controlled by a thermostat 28 positioned in that region of the home or other enclosure wherein the control temperature is to be detected. The thermostat as shown at 28 may be a single thermostat capable of controlling both the air conditioner and furnace or may in fact be separate theremostats.

Throughout the description herein reference will be made to a heat exchanger and means for producing a temperature differential therein. Such reference is intended to refer to the furnace burner as being means for producing a temperature differential in the furnace structure by which heat is delivered to the air being circulated therethrough. The terms employed are also intended to encompass the evaporator 22 as a heat exchanger and the compressor-condenser 26 as the means for producing the temperature differential.

As shown in the drawings, conductors 30 are intended to indicate leads from a 24 volt circuit normally found in conventional furnaces to supply operating voltage to the apparatus to be described.

Normally, the thermostat 28 would be connected directly to the furnace and/or air conditioner, utilizing the 24 volt supply from the furnace for its energization. However, in accordance with the present invention, intermediate efficiency control apparatus, designated at 32, is interposed between the thermostat and the furnace and air conditioner and the leads 30 direct power from the furnace through this apparatus.

As is known, the thermostat normally would detect a lowering of temperature in the enclosures, below a set value, and thus cause the furnace burner to ignite and blower 20 to operate for heating the enclosure. If the temperature in the enclosure requires cooling, the thermostat would then normally actuate the compressor 26 and blower 20 to effect cooling. In both modes of operation, however, the apparatus would be an air temperature changing operation that would continue until the thermostat detected achievement of the desired temperature in the enclosure. As pointed out theretofore, that normal type of operation is highly inefficient and wasteful of energy, all for the reasons already pointed out.

In accordance with the present invention, a signal generated by the thermostat, calling for either heating or cooling, first actuates a primary timer 34 which in turn initiates operation of furnace 12 through conductors 36 or compressor 26 through conductors 38, depending upon whether cooling or heating is required. At the initiation of such operation the primary timer also causes blower 20 to commence operation, acting through conductors 39 and 41, and a timing device in the primary timer starts operating to limit the time of operation of the furnace burner or the compressor to a predetermined maximum time interval. In the case of furnace burner operation, that time period is preferably about ten minutes whereas the compressor 26 is permitted to operate for a maximum time interval of about fifteen minutes. At the end of the proper time period, operation of either the compressor or furnace burner is terminated and such termination initiates the starting of a timer in the blower timer device 40 and causes the blower to continue operation for only a predetermined maximum time interval after termination of operation of either the furnace burner or the compressor. Preferably, the continued operation of the blower 20 is for a time period substantially equal to that during which the furnace burner or the compressor was operating.

The specific circuits and connections in boxes designated 34 and 40 are not shown since such timers and circuit control devices are well known to those skilled in the art and many arrangements may be made which would be clearly obvious to those skilled in the art.

It is to be noted that the primary timer 34 will always limit the maximum time during which either the compressor 26 or furnace 12 can operate to produce a temperature differential in the heat exchanger. Thus, if the thermostat would normally call for lowering or raising the temperature in the enclosure by 5° and if that temperature were changed only 3° in the first 10 (or 15) minutes, the compressor or furnace burner would be shut off and the blower 20 would continue operating for another 10 (or 15) minutes. If, at the end of the blower operation, the temperature in the enclosure had not yet reached the desired value, the described cycle would be repeated. However, if the change in temperature of 5° is consummated before the end of the primary timer period, the compressor and/or furnace would be shut off by the thermostat 28 without running to the end of the predetermined time period built into the primary timer 34.

While a single specific arrangement of components is shown and described herein, the same is intended to be merely illustrative of the principles of the invention and other circuits and apparatus arrangements may be resorted to within the scope of the appended claims.

I claim:

1. A method of operating apparatus for changing the temperature of air in an enclosure and including a thermostat responsive to the temperature of said air, a heat exchanger, a blower for blowing said air through said heat exchanger and means controlled by said thermostat for producing a temperature differential in said heat exchanger, said method comprising the steps of:

causing said thermostat to initiate operation of said means and said blower;

limiting the maximum time of operation of said means to a first predetermined time period and to terminate operation of said means even when said thermostat would normally cause said operation to continue; and causing said blower to continue to blow air through said heat exchanger for only a second predetermined time period after termination of operation of said means.

2. A method of claim 1 wherein said first and second time periods are of approximately equal length.

3. The method of claim 1 wherein said first and second time periods are each of from 10 to 15 minutes.

4. The method of claim 1 wherein said means is a refrigerant compressor and said heat exchanger is an evaporator connected to said compressor.

5. The method of claim 1 wherein said means is a fuel burning furnace and said heat exchanger is a plenum chamber therein.

6. An apparatus for changing the temperature of air in an enclosure and including a thermostat responsive to the temperature of said air, a heat exchanger, a blower for blowing said air through said heat exchanger and means controlled by said thermostat for producing a temperature differential in said heat exchanger, the improvement comprising:

a primary timer responsive to said thermostat for initiating operation of said means and for terminating operation thereof after a first predetermined maximum time period even when said thermostat would normally cause said operation to continue; and a blower control, responsive to initiation of operation of said means by said primary timer, to initiate operation of said blower, said blower control including a blower timer, responsive to termination of said means, to cause said blower to continue to blow air through said heat exchanger for only a second predetermined time period after said termination and to then stop said blower.

7. Apparatus as defined in claim 6 wherein said means is a refrigerant compressor and said heat exchanger is a refrigerant evaporator connected to said compressor.

8. Apparatus as defined in claim 7 wherein said first and second time periods are each on the order of 15 minutes.

9. Apparatus as defined in claim 6 wherein said means is a fuel burning furnace and said heat exchanger is a plenum chamber therein.

10. Apparatus as defined in claim 9 wherein said first and second time periods are each on the order of 10 minutes.

* * * * *